US006651599B2

(12) United States Patent
Wechner

(10) Patent No.: US 6,651,599 B2
(45) Date of Patent: Nov. 25, 2003

(54) FREE-PISTON ENGINES

(76) Inventor: Edward Wechner, 5 Charles Avenue, Minnamurra, New South Wales (AU), 2533

( * ) Notice: Subject to any disclaimer, the term of this patent is extended or adjusted under 35 U.S.C. 154(b) by 17 days.

(21) Appl. No.: 10/050,679

(22) Filed: Jan. 15, 2002

(65) Prior Publication Data

US 2002/0134324 A1 Sep. 26, 2002

(51) Int. Cl.[7] ..... F02B 71/00
(52) U.S. Cl. ..... 123/46 R
(58) Field of Search ..... 123/46 R, 46 A, 123/46 B, 46 SC, 46 E, 46 H, 47 R, 47 A, 47 AB, 47 AA

(56) References Cited

U.S. PATENT DOCUMENTS 5,775,273 A * 7/1998 Beale ..... 123/46 B
6,035,637 A * 3/2000 Beale et al. ..... 60/595
6,170,442 B1 * 1/2001 Beale ..... 123/46 B
6,199,519 B1 * 3/2001 Van Blarigan ..... 123/46 R

FOREIGN PATENT DOCUMENTS

DE 4344915 A1 * 7/1995 ..... H02K/35/00

* cited by examiner

*Primary Examiner*—Henry C. Yuen
*Assistant Examiner*—Hyder Ali
(74) *Attorney, Agent, or Firm*—Jacobson and Johnson

(57) ABSTRACT

A combustion engine having at least one pair of longitudinal opposed cylinder with electricity generating stator means fixed relative thereto and having pistons arranged in the cylinders for cycles of reciprocating compression and power strokes, the pistons being linked together with a linear actuator for movement therewith.

10 Claims, 2 Drawing Sheets

SECTION B - B

SECTION A - A

FREE-PISTON ENGINES

FIELD OF THE INVENTION

This invention relates to internal combustion engines. More particularly although not exclusively it discloses an improved form of free-piston engine.

BACKGROUND OF THE INVENTION

With known prior art free-piston engines such as those described by M. Goertz and L. Peng in March 2000 SAE Paper 2000-01-0996, entitled FREE-PISTON ENGINE ITS APPLICATION AND OPTIMIZATION, and Galileo Research, Inc. at www.galileoresearch.com, 1999 entitled FREE-PISTON ENGINE-GENERATOR TECHNOLOGY the gas enters the combustion chamber via intake slots through the wall of the cylinder sleeve. This is typical of the method used on most conventional two stroke internal combustion engines. The disadvantage of such intake arrangement is that as the piston rings slide over the intake slots (twice during each stroke) the radial support area is reduced and a slight ring deformation occurs. The deformation results from the elasticity of the unsupported ring material when subjected to radial forces imposed by gas pressure and the pre-tension in the rings. This deformation accelerates the wear rate of the rings and cylinder sleeve and is partly responsible for abandonment of the two stroke engine in modern passenger cars.

It is also known to provide a valve-in-piston arrangement in a reciprocating piston crankcase engine as described in Australian patent application 63021/99 by E. Wechner. Such engines however are are relatively inefficient when used in modern hybrid vehicles as additional mechanical linkage is required to generate the electrical power required for the drive wheels and energy storage cells.

SUMMARY OF THE INVENTION

It is therefore an object of this invention to ameliorate the aforementioned disadvantages and accordingly an internal combustion engine is disclosed having at least one pair of longitudinally opposed cylinders with electricity generating stator means fixed relative thereto, respective pistons arranged in said cylinders for cycles of reciprocating compression and power strokes, inlet valve means for introducing air or a fuel mixture into said cylinders prior to said compression strokes, outlet valve means for the expulsion of exhaust gases following said power strokes and said pistons being linked together with a linear actuator for movement therewith whereby during operation of said engine the reciprocating strokes of said pistons and linear actuator with respect to said stator means generates usable electrical energy and said inlet valve means being located in said pistons and comprising a portion of the heads thereof.

BRIEF DESCRIPTION OF THE DRAWINGS

The currently preferred embodiment of the invention will now be described with reference to the attached drawings in which.

DETAILED DESCRIPTION OF THE PREFERRED EMBODIMENT

Figure 1:
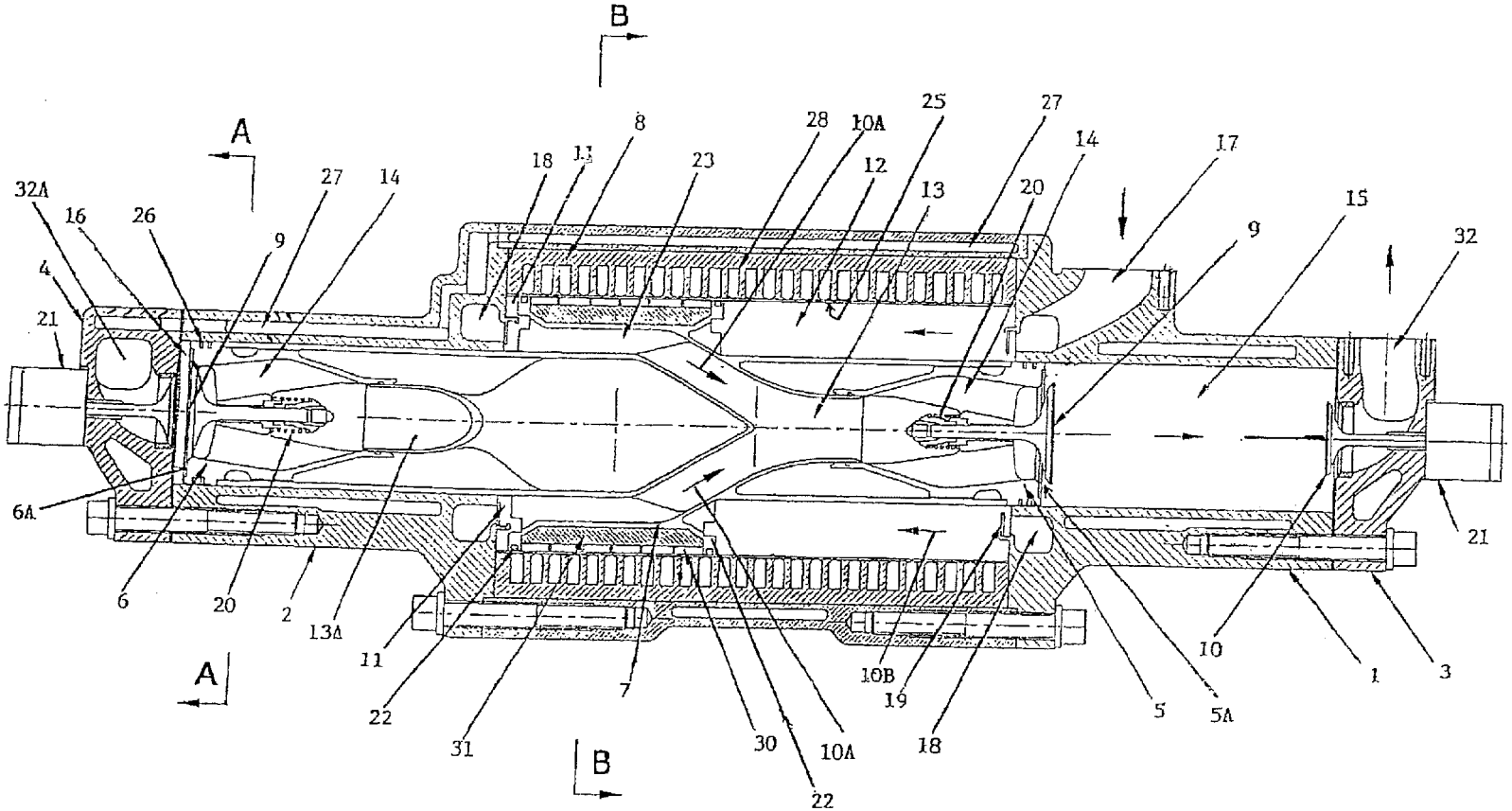
FIG. 1 shows a cross-sectional schematic view of a free-piston engine along the centre axis of the cylinders.

Referring first to FIG. 1 the main components of the engine are the longitudinally opposed cylinder blocks 1 and 2, the cylinder heads 3 and 4, the pistons 5 and 6, linear actuator 7 and electricity generating stator 8.

As with prior art free-piston engines the cylinders fire alternately in the two stroke cycle and the resulting reciprocating linear motion is converted into electrical energy by means of relative movement between the linear actuator and stator assemblies.

In accordance with this invention however the inlet valves comprise poppet valves 9 which are located in the heads 5A and 6A of the pistons.

In FIG. 1 the piston 5 is shown at the end of the expansion or power stroke in cylinder 1. Both the inlet valve 9 and exhaust valve 10 are thus open to enable the two stroke gas exchange or scavenging process to take place. The intake gas 10A for this scavenging process was compressed in the linear actuator compression chamber 11 during the preceding expansion stroke of piston 5. The pressure obtained for the intake gas 10A is sufficient to open the inlet valve 9 in the piston 5 against both the force of coil spring 20 and the opposing kinetic force from deceleration of the valve mass 9 at the end of the power stroke. During this gas exchange process the cool intake gas 10A passes through the linear actuator heat exchanger 23, the charge pipe 13, the piston heat exchanger 14 and the inlet valve 9 before entering the combustion chamber 15. The incoming pressure of this gas 10A assists the evacuation of the exhaust gas through the exhaust or outlet valve 10 and port 32. There is a control solenoid 21 in the cylinder head 3. This opens the exhaust valve 10 for selected variable time periods to optimise the efficiency of the gas exchange at a given power consumption. For example, at low power consumption only a small amount of exhaust gas is evacuated through the valve 10. This in turn limits the entry of intake gas 10A to the mass required to maintain the desired idle speed of the engine. Such arrangement releases a minimum amount of pressure in the combustion chamber during the gas exchange process to reduce pumping losses. At maximum power the valve 10 is held open long enough to evacuate substantially all of the exhaust gas. This allows the maximum mass of fresh intake gas 10A to enter the combustion chamber. As with the prior art valve-in-piston engine the inlet valve 9 is held closed during the subsequent compression stroke against the opposing kinetic forces of deceleration by gas pressure in the chamber 15.

Figure 3:
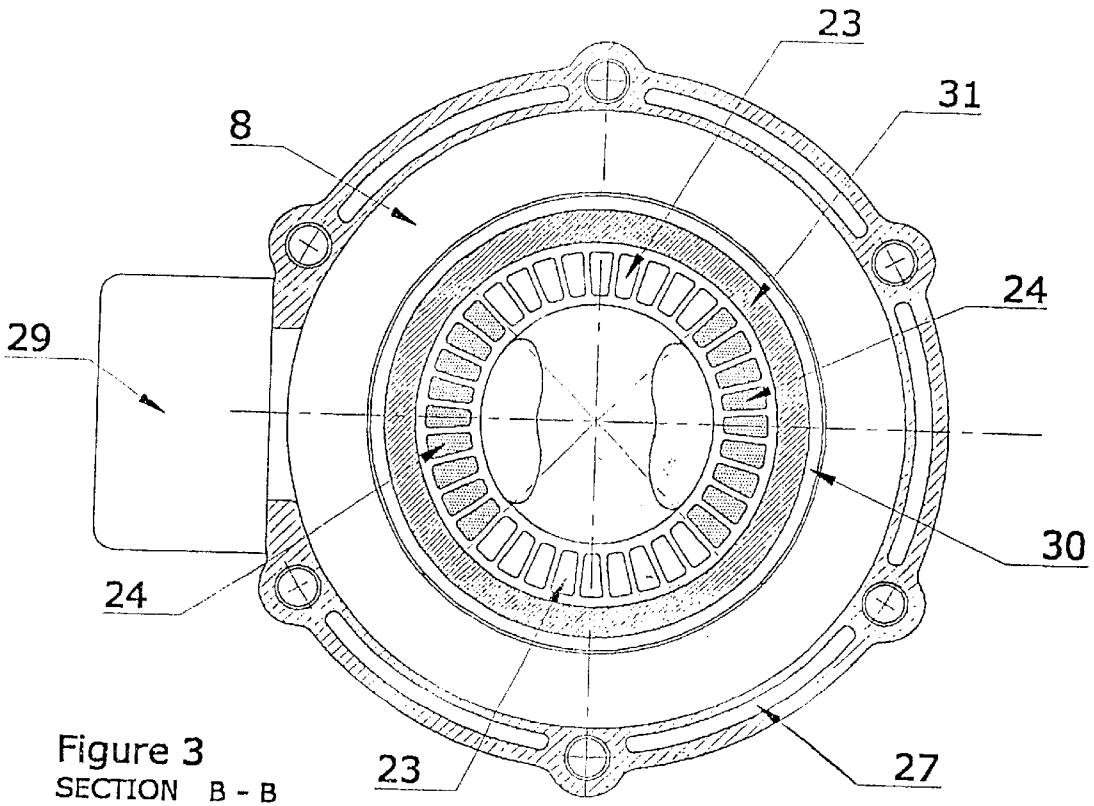
FIG. 3 is a cross-sectional view of the engine along the lines B—B of FIG. 1.
Figure 2:
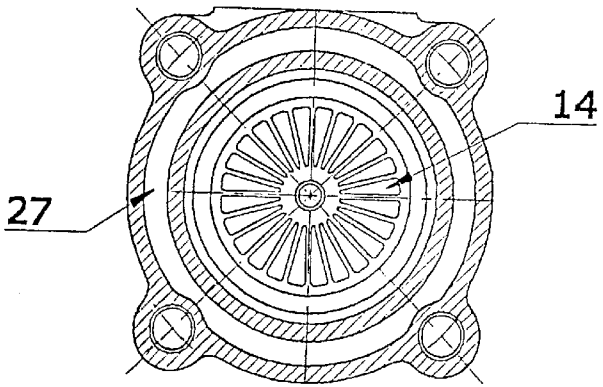
FIG. 2 shows a cross-sectional view of the engine along the lines A—A of FIG. 1.

The opposite engine piston 6 is shown by FIG. 1 in the ignition position after having completed a compression stroke. There is a linear heat exchanger 24, charge pipe 13A and outlet port 32A associated with piston 6 and cylinder 2 similar to that described earlier but orientated at 90 degrees as shown in FIG. 3. During this compression stroke of piston 6 fresh intake gas 10B was drawn by the linear actuator 7 in through the inlet 17, the ring chamber 18, the ring valve 19 and into the compression chamber 12. During the next expansion or power stroke of piston 6 after ignition this gas 10B will be compressed in chamber 12 to comprise the subsequent intake charge for the combustion chamber 16 of cylinder 2.

The linear actuator 7 is equipped with gas seals 22 on both ends to facilitate its function as a compressor piston for the gas exchange process. This eliminates the need for a external intake gas charging device. Between the electricity generating stator 8 and the linear actuator there is also a cylindrical sleeve 25 which provides a dynamic mating surface for the gas seals 22. This sleeve 25 should be electrically non-conductive, non-magnetic and sufficiently thin to avoid adverse effects on the generating process. Suitable material may include ceramics or high temperature composite plastics which may be either deposited on the surface or pressed into the stator 8.

Although in the illustrated example of the engine only a single inlet and outlet valve are shown for each cylinder the invention extends to the use of more than one inlet valve in each piston and more than one outlet valve in each cylinder head.

Other components of the preferred embodiment as shown in the drawings are as follows:

| | |
|---|---|
| 27 | Cooling water jacket |
| 28 | Electricity generating coils |
| 29 | Electric power outlet junction box |
| 30 | Permanent magnets |
| 31 | Permanent magnet back iron |

It will be thus be appreciated that this invention at least in the form of the embodiment disclosed provides a novel and useful improvement to free-piston internal combustion engines. Clearly however the example disclosed is only the currently preferred form of the invention and a wide variety of modifications may be made which would be apparent to a person skilled in the art. For example the shape and configuration of the valves and linear actuator gas compressor may be changed according to engine design requirements. Also, while the engine described has only two opposed cylinders the invention could be extended to any number of pairs.

The claims defining the invention are as follows:

1. An free-piston internal combustion engine having at least one pair of longitudinal opposed cylinders with electricity generating stator means fixed relative thereto, respective pistons arranged in said cylinders for cycles of reciprocating compression and power strokes, inlet valve means for introducing air or a fuel mixture into said cylinders prior to said compression stroke, outlet valve means for the expulsion of exhaust gas following said power stroke and said pistons being linked together with a linear actuator for movement therewith whereby during operation of said engine the reciprocating strokes of said pistons and linear actuator with respect to said stator means generates usable electrical energy and said inlet valve means being located in said pistons and comprising a portion of the heads thereof.

2. The free-piston internal combustion engine as claimed in claim 1 wherein said cylinders fire alternately in a two stroke cycle.

3. The free-piston internal combustion engine as claimed in claim 2 where said stator means is located between said opposed cylinders and said linear actuator is located between said respective pistons.

4. The free-piston internal combustion engine as claimed in claim 3 wherein said air or fuel mixture is drawn into a compression chamber associated with said linear actuator during said compression strokes.

5. The free-piston internal combustion engine as claimed in claim 4 wherein said air or fuel mixture is compressed in said compression chamber during said power strokes before introduction into said cylinders.

6. The free-piston internal combustion engine as claimed in claim 5 wherein said inlet means are poppet valves which are biased to a closed position by springs and said air or fuel mixture is compressed to a pressure that opens said poppet valves against said springs and opposing kinetic forces to initiate gas exchange at the end of said power strokes.

7. The free-piston internal combustion engine as claimed in claim 6 wherein during the compression strokes the inlet valve means are held closed by gas forces in the cylinders.

8. The free-piston internal combustion engine as claimed in claim 7 wherein said combustion chamber is formed by a cylindrical sleeve disposed inside said stator means and said linear actuator is fitted with gas seals to engage said sleeve and act as a reciprocating compressor piston.

9. The free-piston internal combustion engine as claimed in claim 8 wherein said outlet valve means are poppet valves located in the heads of said cylinders and are opened by solenoids for variable periods to optimise the efficiency of said gas exchange at a given power level.

10. The free-piston internal combustion engine as claimed in claim 9 wherein said cylindrical sleeve is formed from a ceramic or a high temperature plastic.

* * * * *